US006759805B2

(12) United States Patent
de Cort et al.

(10) Patent No.: US 6,759,805 B2
(45) Date of Patent: Jul. 6, 2004

(54) CIRCULAR FILAMENT LAMP

(75) Inventors: Francis Gerard de Cort, Leicester (GB); Derek Peter Hurst, Loughborough (GB)

(73) Assignee: General Electric Company, Schenectady, NY (US)

( * ) Notice: Subject to any disclaimer, the term of this patent is extended or adjusted under 35 U.S.C. 154(b) by 684 days.

(21) Appl. No.: 09/809,541

(22) Filed: Mar. 15, 2001

(65) Prior Publication Data

US 2004/0056584 A1 Mar. 25, 2004

(51) Int. Cl.[7] ..... H01K 1/50

(52) U.S. Cl. ..... 313/578; 313/573; 313/580; 313/634; 219/620; 219/209; 219/541; 219/542; 219/544; 219/552

(58) Field of Search ..... 313/573, 315, 313/578–580, 634, 623, 110, 45; 219/552, 553, 643, 674, 209, 541, 542, 544, 548, 546, 620

(56) References Cited

U.S. PATENT DOCUMENTS 4,857,709 A * 8/1989 Janssen et al. ..... 219/459.1
6,472,641 B2 * 10/2002 Suzuki ..... 219/411
6,654,549 B1 * 11/2003 Konishi ..... 392/407
6,680,572 B1 * 1/2004 Morel ..... 313/574

FOREIGN PATENT DOCUMENTS

| | | |
|---|---|---|
| DE | 3826669 | 2/1990 |
| EP | 356528 | 3/1990 |
| EP | 0 438 254 A2 | 7/1991 |
| JP | 3-89448 | 4/1991 |
| JP | 3-110754 | 5/1991 |

* cited by examiner

*Primary Examiner*—Ashok Patel
(74) *Attorney, Agent, or Firm*—Fay, Sharpe, Fagan, Minnich & McKee, LLP

(57) ABSTRACT

A circular filament lamp comprises a filament supported within an envelope which comprises a tube formed as the major part of a circle. The ends of the tube terminate in pinch seals through which extend current carrying assemblies connected to the filament. The pinch seals overlap one another circumferentially of the lamp, and are offset from one another on either side of a plane containing the axis of the filament.

6 Claims, 5 Drawing Sheets

CIRCULAR FILAMENT LAMP

BACKGROUND OF THE INVENTION

This invention relates to circular filament lamp, that is to say a lamp in which an incandescent filament such as a coiled wire extends around a generally circular path, within a tubular enclosure. Such a lamp is particularly, although not exclusively, useful in an infrared heater lamp for use in a cooker hob.

Circular halogen infra-red heater elements for cooker hobs are well known, and typically consist of a tungsten filament supported within a quartz envelope. The envelope is in the form of a tube which is bent around to form the major part of a circle, with the ends of the tube being bent outwards and extending generally parallel with a radius of the circle, as depicted in FIG. 1 of the accompanying drawings. The ends of the tube are pinched, during manufacture when the quartz is heated to a plastic state, to form pinch seals. The pinch seals encapsulate the current carrying assemblies for the filament, with each filament end being secured to the assembly inside the quartz envelope, and with a current lead welded to each current carrying assembly outside the envelope. In a cooker hob application, the lamp is contained within a heater pan assembly, which is typically of ceramic material, or which may be in the form of a pressed metal disc, with the ends of the pinch seals and the current leads extending out of the heater pan.

The known lamps suffer from the disadvantages that they are difficult to manufacture due to filament tensions around the small radius bends where the tube ends extend outwards from the circular portion of the lamp, and that the ends of the lamp extend outside the heater pan, with the result that the lamp element does not make maximum use of the area available for the heater pan assembly. Also, there is an unlit portion of the lamp in the vicinity of the tube ends whereby the lamp, in use, provides a broken or interrupted circle of heat (and light). This may give rise to a fall in heating efficiency in the vicinity of the tube ends, as well as being aesthetically unpleasing.

BRIEF SUMMARY OF THE INVENTION

According to an embodiment of the invention, there is provided a circular filament lamp comprising a filament supported within an envelope which comprises a tube with its longitudinal axis formed as the major part of a circle, the ends of the tube terminating in pinch seals through which extend current carrying lead through assemblies connected to the filament, the pinch seals overlapping one another generally circumferentially of the lamp.

The pinch seals may be offset from one another on either side of a plane containing the axis of the filament, or they may be offset in a direction generally radially of said circle.

The upper surfaces of the envelope, in the region of the ends of the tube, may be surface treated to cause them to diffuse radiation from the filament into the unlit regions at the tube ends, thereby giving better distribution of heat and light.

The lamp provides a more compact tube into which it is easier to install the filament; which may be contained completely within its heater pan, thereby optimising the use of space; and which has improved heating efficiency in the region of the ends of the tube.

BRIEF DESCRIPTION OF THE DRAWINGS

Embodiments of the invention will now be described, by way of example, with reference to the accompanying drawings, in which.

DETAILED DESCRIPTION OF THE DRAWINGS

Figure 1:
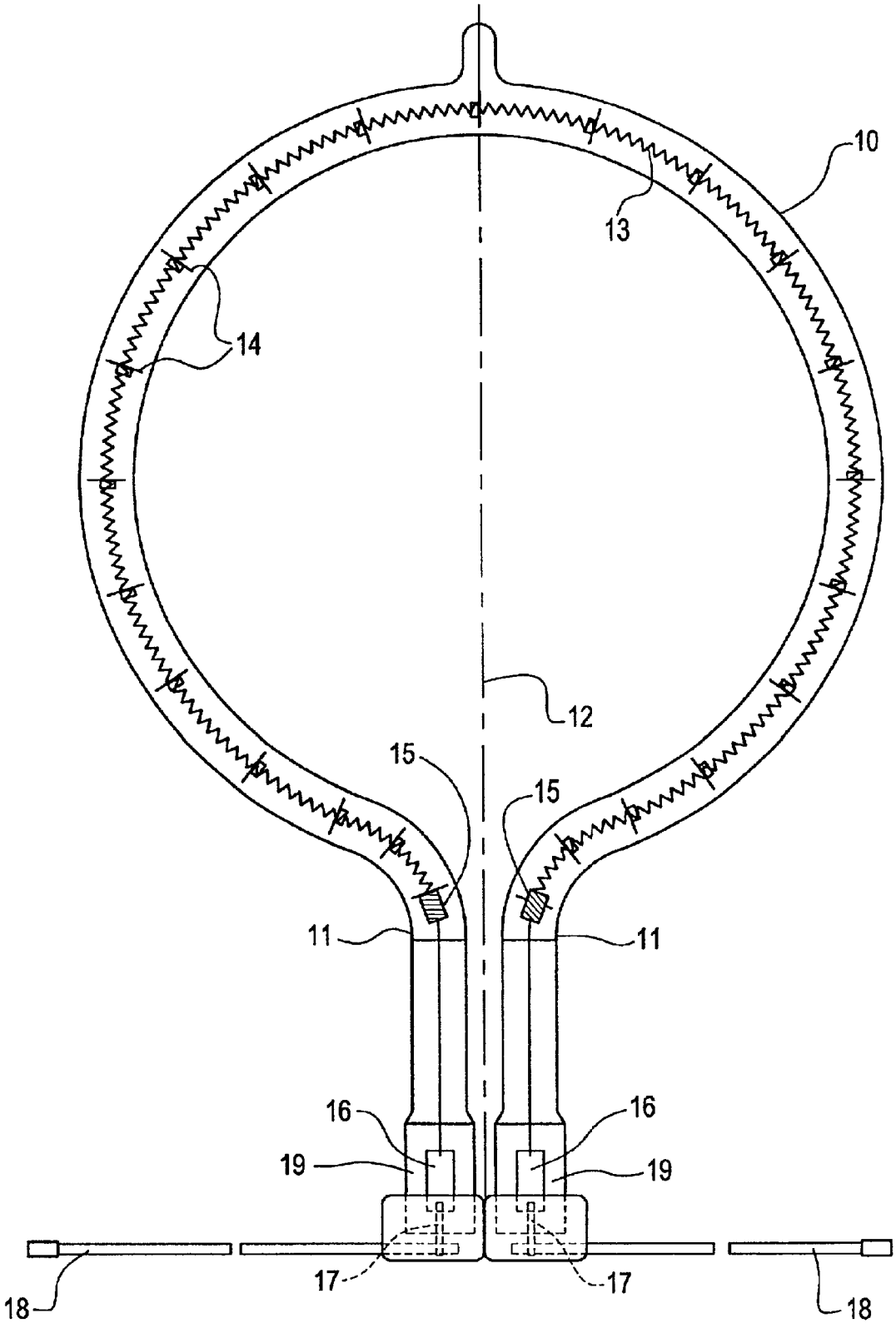
FIG. 1 PRIOR ART
FIG. 1 is a plan view of a prior art circular filament lamp.

Referring to FIG. 1, there is shown a prior art filament lamp for a cooker hob. An envelope 10, typically of quartz, is in the form of a hollow tube with an outside diameter of the order of 8 mm. The tube is bent round into a generally circular shape, with its ends 11 bent outwardly, generally parallel with one another, on either side of a radius 12 of the circle. The tube is sealed at each end, and contains a halogen gas. Supported generally centrally within the envelope 10 is a filament 13, of helically coiled tungsten wire. The axis of the filament coil thus substantially corresponds with the axis of the envelope tube, and lies in the same plane. A plurality of supports 14 comprise pierced metal discs through which the filament passes, with the outside circumference of the discs slideably engaging the inside wall of the envelope 10. Alternative ways of supporting the filament include spiral wire supports, or periodic enlargements of the diameter of the filament coil, such that the enlarged diameter sections engage the inner wall of the envelope 10. In another alternative configuration, the envelope walls may be pinched inwards to engage the filament coil. Each end of the filament is terminated by a closely-wound terminating coil 15, one end of which is welded to the molybdenum foil 16 of a pin and foil assembly. A pin 17, which may be a linear pin or a U-shaped pin, is welded to the other end of the foil 16, and a current lead 18 is welded across the pin 17. Electrical power for the filament is fed through the current lead 18 by means of a suitable connector (not shown). The foil 16 and pin 17 are encapsulated within a pinch seal 19, formed by applying external pressure to the end of the envelope tube during manufacture when the tube is heated to a temperature such that it is in a plastic, deformable, state.

Figure 2:
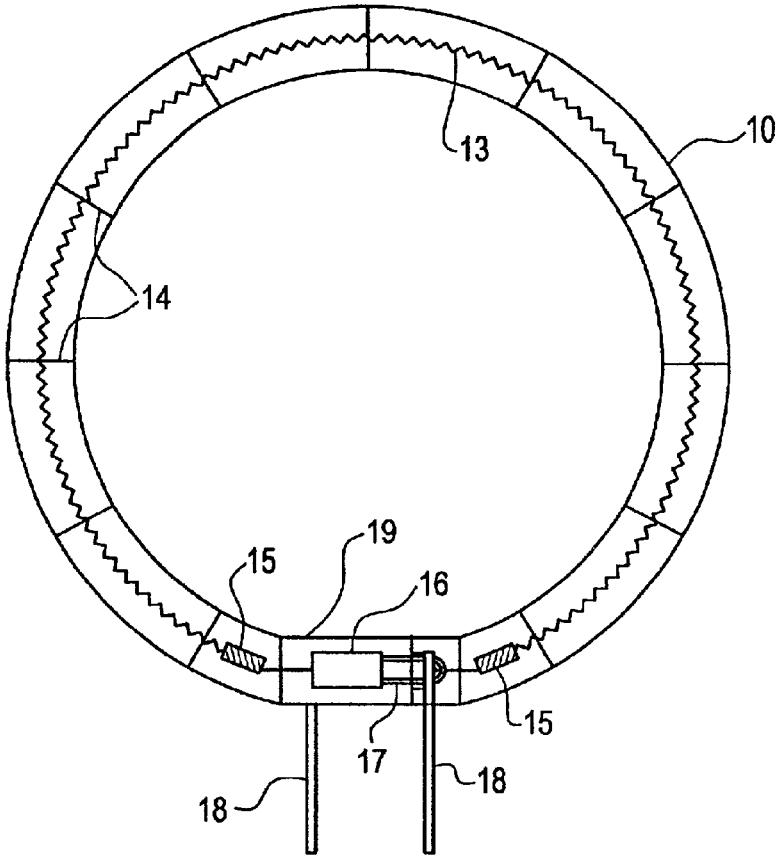
FIG. 2 is a plan view of a circular filament lamp of an embodiment of the invention.
Figure 3:
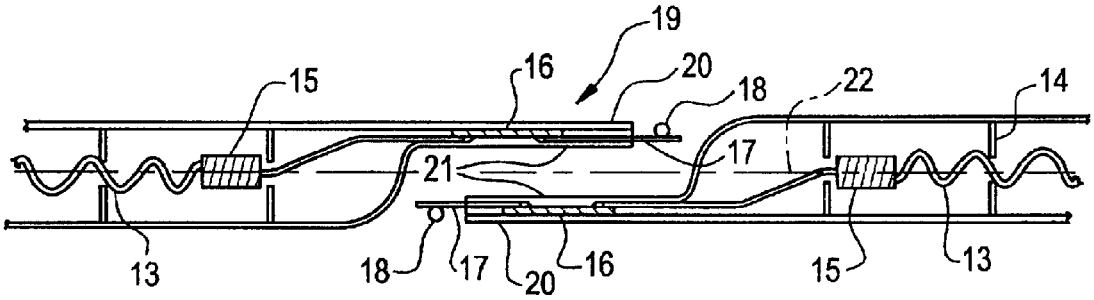
FIG. 3 is a partial side view, in cross-section, showing the ends of the lamp tube of FIG. 2.

Referring now to FIGS. 2 and 3, a first embodiment of the circular filament lamp is generally of similar construction to the prior art lamp of FIG. 1, except in the region of the ends of the lamp tube. The pinch seals 19 which form the ends of the tube overlap one another in the circumferential direction. To accommodate the overlap, the pinch seals are offset from one another on either side of the plane containing the axis 22 of the filament. The axis 22 corresponds with the longitudinal axis of the tube forming the envelope 10, and forms the major part of a circle. Each pinch seal has its outward facing wall 20 generally aligned with the outer wall of the envelope 10, and its inward facing wall 21 spaced from its outward facing wall 20 by less than half the outside diameter of the envelope 10. The offset pinch seals allow the ends of the quartz envelope to overlap without interfering with one another, therefore enabling a flat ring to be made. The top surface of the envelope can be surface treated, for example by sand blasting or chemical etching, to provide a diffusing effect so that radiation travelling through the quartz pinch seals and the adjacent parts of the envelope diffuses upwards, thereby reducing the contrast between the lit filament and the gap between its ends.

Figure 4:
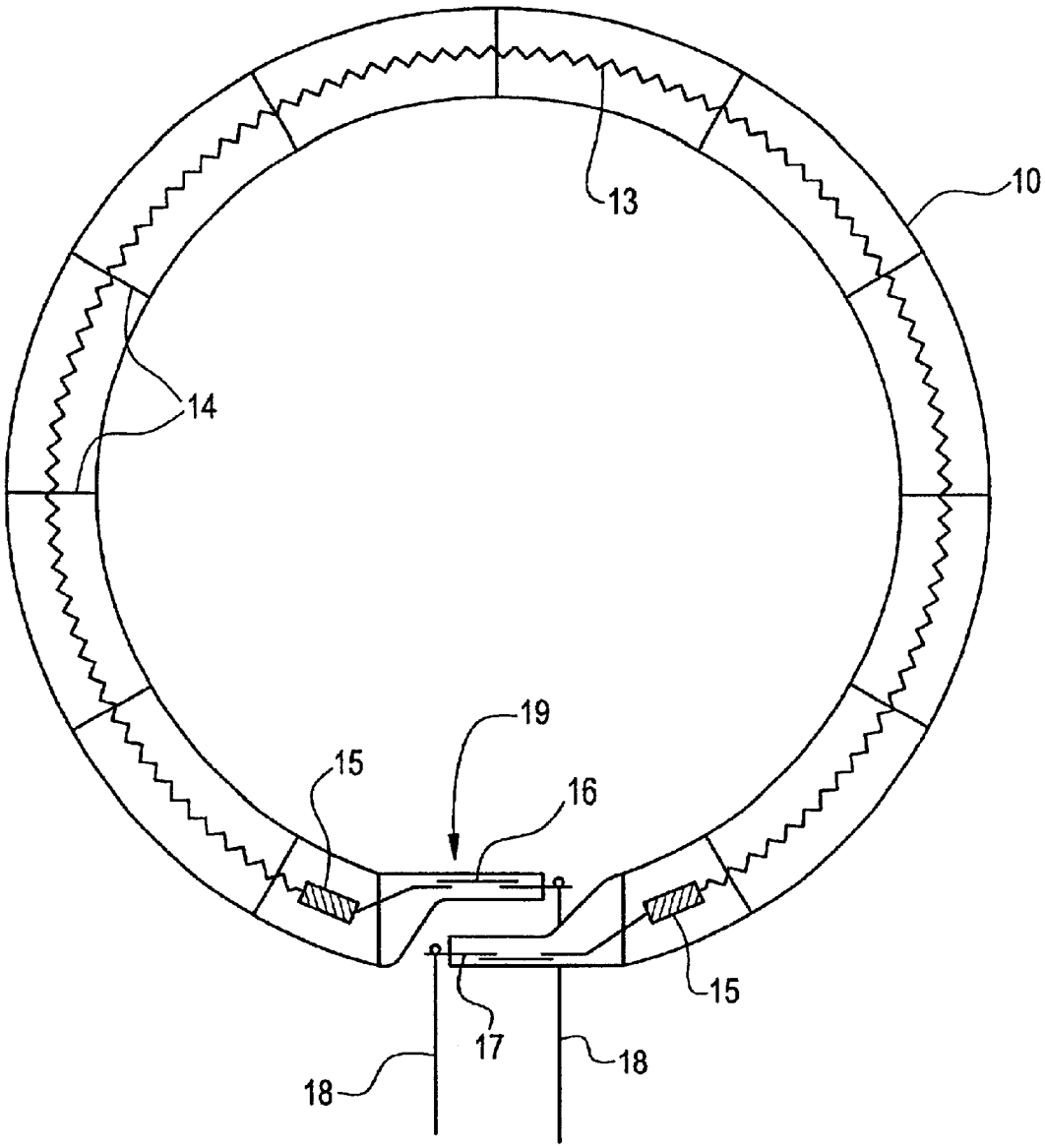
FIGS. 4, 5 and 6 are plan views of alternative embodiments of a circular filament lamp.

In a first alternative embodiment, shown in FIG. 4, the pinch seals 19 are formed so that they lie in planes perpendicular to the plane containing the axis 22. In other words, the configuration is generally similar to that of FIGS. 2 and 3, except that the pinch seals are rotated through ninety degrees.

Figure 5:
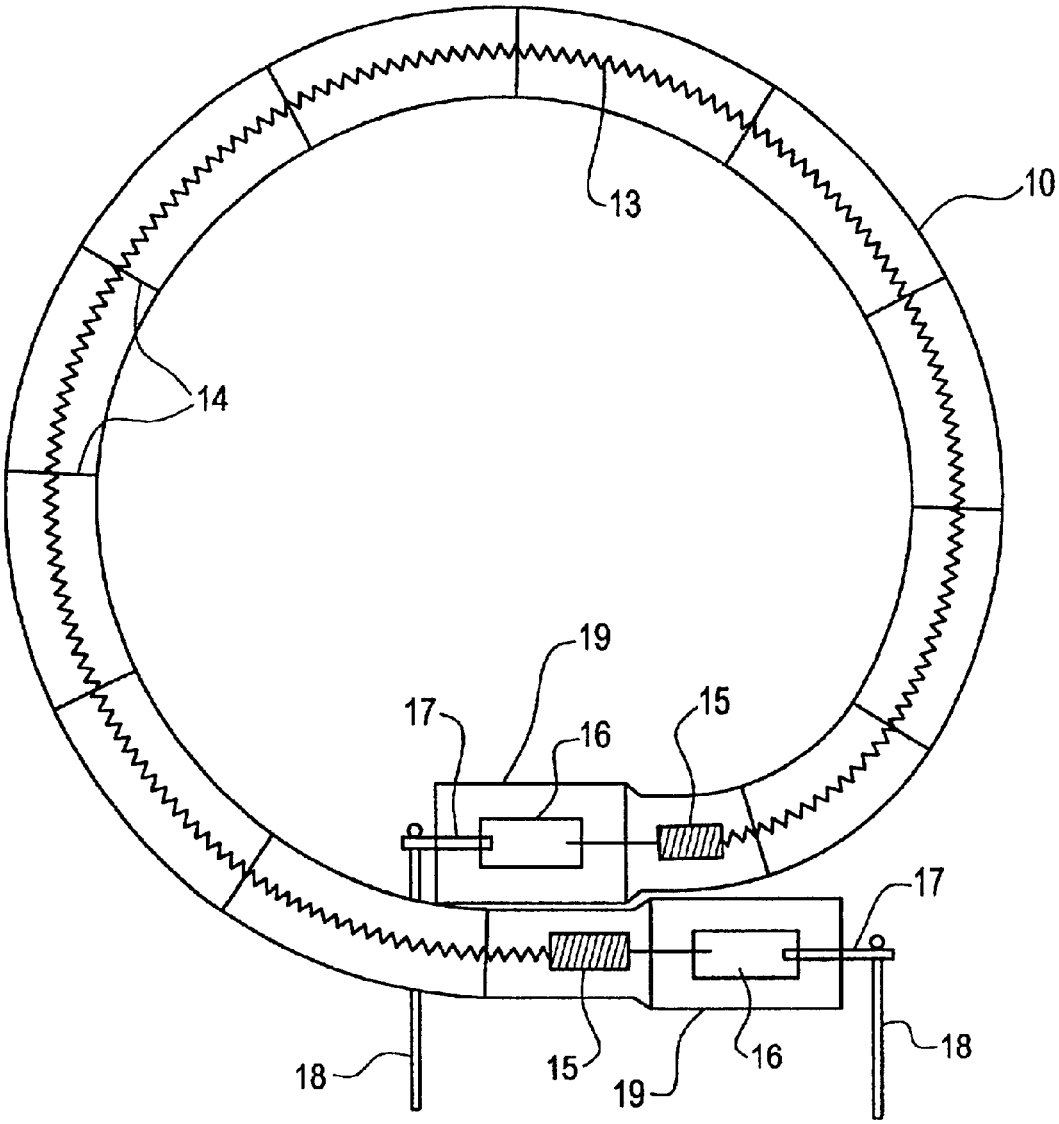

In a second alternative embodiment, shown in FIG. 5, the pinch seals 19 are displaced from one another in the radial direction, and in this case the 'overlap' is in the sense that one end of the envelope 10 passes beside the other end, rather than taking up only part of the volume which would have been occupied by the tube of the envelope 10 had that tube been continuous in the volume where the overlap occurs. Although the pinch seals are shown flattened into the plane of the axis 22, they could equally be flattened in planes perpendicular to the plane containing the axis 22.

Figure 6:
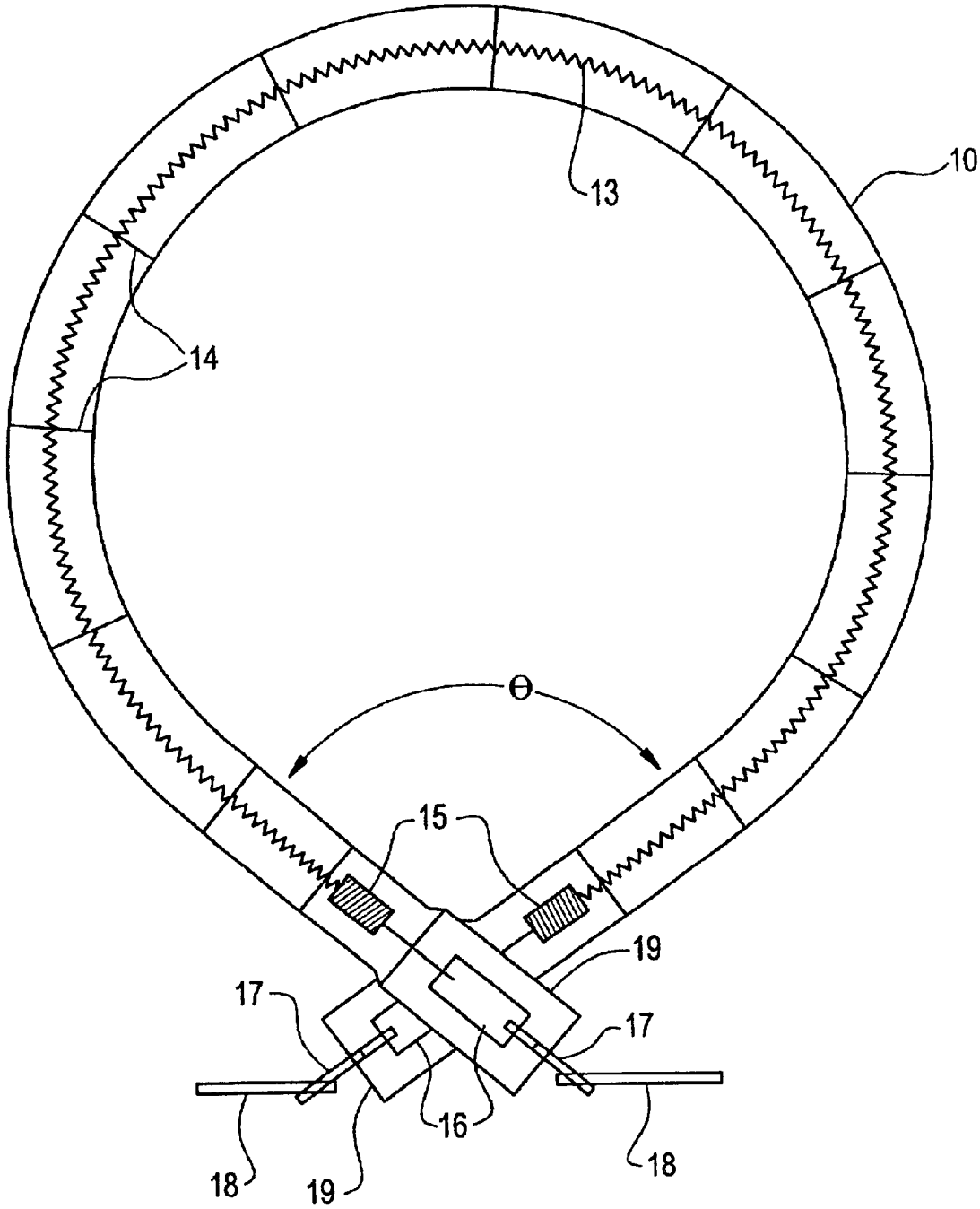

In a third alternative embodiment, shown in FIG. 6, the pinch seals 19 are formed on generally linear extensions from the circular part of the envelope. The angle θ between the linear extensions could be a right angle, or any suitable angle greater or less than a right angle. The pinch seals in this case are offset from one another on either side of the plane containing the axis 22.

Various modifications in structure and/or steps and/or function may be made by one skilled in the art without departing from the scope of the invention.

What is claimed is:

1. Circular filament lamp comprising a filament supported within an envelope which comprises a tube with its longitudinal axis formed as the major part of a circle, the ends of the tube terminating in pinch seals through which extend current carrying lead through assemblies connected to the filament, the pinch seals overlapping one another generally circumferentially of the lamp.

2. The lamp of claim 1 wherein the pinch seals are offset from one another on either side of a plane containing the axis.

3. The lamp of claim 1 wherein the pinch seals are offset from one another in a direction generally radially of the circle.

4. The lamp of claim 1, wherein the outer surfaces of the pinch seals are surface treated to diffuse radiation from the filament.

5. The lamp of claim 2, wherein the outer surfaces of the pinch seals are surface treated to diffuse radiation from the filament.

6. The lamp of claim 3, wherein the outer surfaces of the pinch seals are surface treated to diffuse radiation from the filament.

* * * * *